US006469637B1

(12) United States Patent
Seyler et al.

(10) Patent No.: US 6,469,637 B1
(45) Date of Patent: Oct. 22, 2002

(54) ADJUSTABLE SHEAR VALVE MUD PULSER AND CONTROLS THEREFOR

(75) Inventors: Terry A. Seyler, The Woodlands; Macmillan M. Wisler, Kingwood, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/373,138

(22) Filed: Aug. 12, 1999

(51) Int. Cl.[7] ..... G01V 3/00

(52) U.S. Cl. ..... 340/856.3; 340/854.3; 367/84; 367/85; 181/102

(58) Field of Search ..... 340/856.3, 854.3, 340/855.4; 367/83, 84, 85; 181/102

(56) References Cited

U.S. PATENT DOCUMENTS

| | | | |
|---|---|---|---|
| 3,958,217 A | 5/1976 | Spinnler | 340/18 |
| 4,630,244 A | 12/1986 | Larronde | 367/84 |
| RE32,463 E | 7/1987 | Westlake et al. | 175/48 |
| 5,215,152 A | 6/1993 | Duckworth | 175/48 |
| 5,586,084 A | 12/1996 | Barron et al. | 367/85 |

FOREIGN PATENT DOCUMENTS

| | | |
|---|---|---|
| GB | 2156405 A | 10/1985 |

*Primary Examiner*—Timothy Edwards, Jr.
(74) *Attorney, Agent, or Firm*—Steve Rosenblatt

(57) ABSTRACT

A telemetry system involving a shear-type mud pulser valve as the preferred embodiment is described. The control system includes a motor driver for the mud pulser which, in essence, moves one movable plate with respect to a stationary plate to create openings of various sizes. Pressure is sensed uphole of the pulser valve and is compared in real time to the desired pressure pulse amplitude. By allowing different relative rotational positions of the rotatable plate with respect to the stationary plate, different amplitudes can be achieved to further enhance the transmission of data to the surface. The control system compensates for wear in the mud pulser valve itself as well as drastic changes in mud flow and pressure. The configuration is simple and not prone to fouling from grit or other particles in the mud. The system is capable of creating an initial baseline array of a variety of pulse amplitudes, and thereafter providing the required relative rotation between the stationary and rotatable plates so as to be able to duplicate the baseline pulse amplitudes despite changes in the valve condition or in the flowing conditions of the mud.

19 Claims, 3 Drawing Sheets

ADJUSTABLE SHEAR VALVE MUD PULSER AND CONTROLS THEREFOR

FIELD OF THE INVENTION

The field of this invention relates to telemetry systems for transmitting data from downhole drilling assemblies to the surface, and more particularly to a mud-pulsing valve and control system which can generate multi-level signals by producing a variety of pressure amplitude levels so that the quantity of data encoded or the number of bits transmitted can be increased without increasing the frequency of the transmitted signal.

BACKGROUND OF THE INVENTION

Measurement-While-Drilling (MWD) or Logging-While-Drilling (LWD) applications use a mud-pulse system of telemetry to create acoustic signals in the drilling fluid that is circulated under pressure through the drillstring during drilling operations. Information acquired by downhole sensors is transmitted by suitably timing the formation of pressure pulses in the mud stream. This information is received and decoded by a pressure transducer and computer at the surface. Typically, these systems have involved a valve and a control mechanism known as a pulser or a mud pulser. Operation of the valve sends a pulse up the drillstring at the velocity of sound in the drilling mud. The rate of transmission of data is relatively slow due to pulse spreading, distortion, attenuation, modulation rate limitations, and other destructive forces such as ambient noise in the drillstring. The mud pulser generates digital 1's and 0's, depending on whether it is open or closed. One prior attempt to increase the data rate is to increase the frequency of the pulses. However, increasing the pulse frequency makes it more difficult to distinguish between adjacent pulses because of short resolution periods.

Negative pulsing systems employ a valve which temporarily allows flow from the drill collar into the annulus, thus bypassing the bit. These systems have a disadvantage of taking flow away from the bit. Positive pressure pulse systems have been- created by temporarily restricting the downward flow of drilling fluid by partial blocking of the fluid path in the drillstring. Pulse detection at the surface can sometimes become difficult due to attenuation and distortion of the signal and the presence of noise generated by the mud pumps, the downhole mud motor, and elsewhere in the drilling system. The presence of grit and other particles in the mud also creates certain operational problems for transducers in the drillstring. Both the positive and negative mud pulse systems generate base band signals. A desirable objective to increase the transmission rate of data is to provide an increased band width signal in the form that provides easy delineation at the surface of the well.

In the past, mud pulse systems that transmit mud pulse signals of differing amplitudes have been developed. In one design, a poppet and orifice structure uses a configuration which provides a tendency for the poppet to remain in the closed position. A bypass line is provided around the poppet and orifice and to a driving piston on the poppet. The poppet valve opens by a pilot valve connected on the bypass conduit of the piston assembly. When the pilot valve turns off, mud flow is blocked through the piston assembly. Relief valves are provided in the bypass conduit downstream of the piston.

These relief valves are pre-calibrated to a particular pressure level which causes each valve to leak mud to prevent the predetermined pressure level from being exceeded. Thus, use of a variety of relief valves allows for the creation of a pressure pulse with an independent amplitude. This system and variations thereof are described in detail in U.S. Pat. No. 5,586,084.

However, this system suffers from various disadvantages. The control that it provides over the movements of the poppet are, at best, indirect. Through the use of the bypass line, the movements of the poppet are controlled by an applied hydraulic pressure acting in conjunction with a spring force. The physical movements of the poppet are not measured; thus, when the relief valve or valves selected reach their predetermined release pressure, the specific amplitude of the pulse generated is uncertain. This is also because erosion on the orifice or poppet affects the amplitude of the pulse generated and the control system described in U.S. Pat. No. 5,586,084 has no provisions for compensation for such erosion effects. Additionally, the use of bypass passages in drilling mud service also creates potential plugging problems in the small components, which would undermine the effectiveness of that system. The system of the prior art thus requires the use of many relief valves or a motor-driven variable restrictor which further presents operational difficulties in mud service. These components must be calibrated for the poppet and orifice combination in its new condition and cannot respond effectively to effects of erosion or dramatic differences in mud flow rates and operating pressures.

It is an objective of the present invention to provide a mud pulser whose position is, directly set in response to measured pressure uphole in the drill-string. Another objective of the present invention is to be able to obtain greater precision in the amplitude of the pulses generated by sensing not only the measured pressure, but also its rates of increase. Another objective is to use the measured pressure from the pulses generated to translate directly to physical movement of the mud pulser to obtain greater control of the pulse amplitudes generated. Another objective is to be able to create baseline amplitudes and to maintain such amplitudes despite changing physical conditions of the mud pulser or in pressure and flowrates of the mud circulating through the drillstring. These and other advantages of the present invention will become more apparent to those skilled in the art from a review of the preferred embodiment described below.

SUMMARY OF THE INVENTION

A telemetry system involving a shear-type mud pulser valve as the preferred embodiment is described. The control system includes a motor driver for the mud pulser which, in essence, moves one movable plate with respect to a stationary plate to create openings of various sizes. Pressure is sensed uphole of the pulser valve and is compared in real time to the desired pressure pulse amplitude. By allowing different relative rotational positions of the rotatable plate with respect to the stationary plate, different amplitudes can be achieved to further enhance the transmission of data to the surface. The control system compensates for wear in the mud pulser valve itself as well as drastic changes in mud flow and pressure. The configuration is simple and not prone to fouling from grit or other particles in the mud. The system is capable of creating an initial baseline array of a variety of pulse amplitudes, and thereafter providing the required relative rotation between the stationary and rotatable plates so as to be able to duplicate the baseline pulse amplitudes despite changes in the valve condition or in the flowing conditions of the mud.

DETAILED DESCRIPTION OF THE PREFERRED EMBODIMENT

Figure 1:
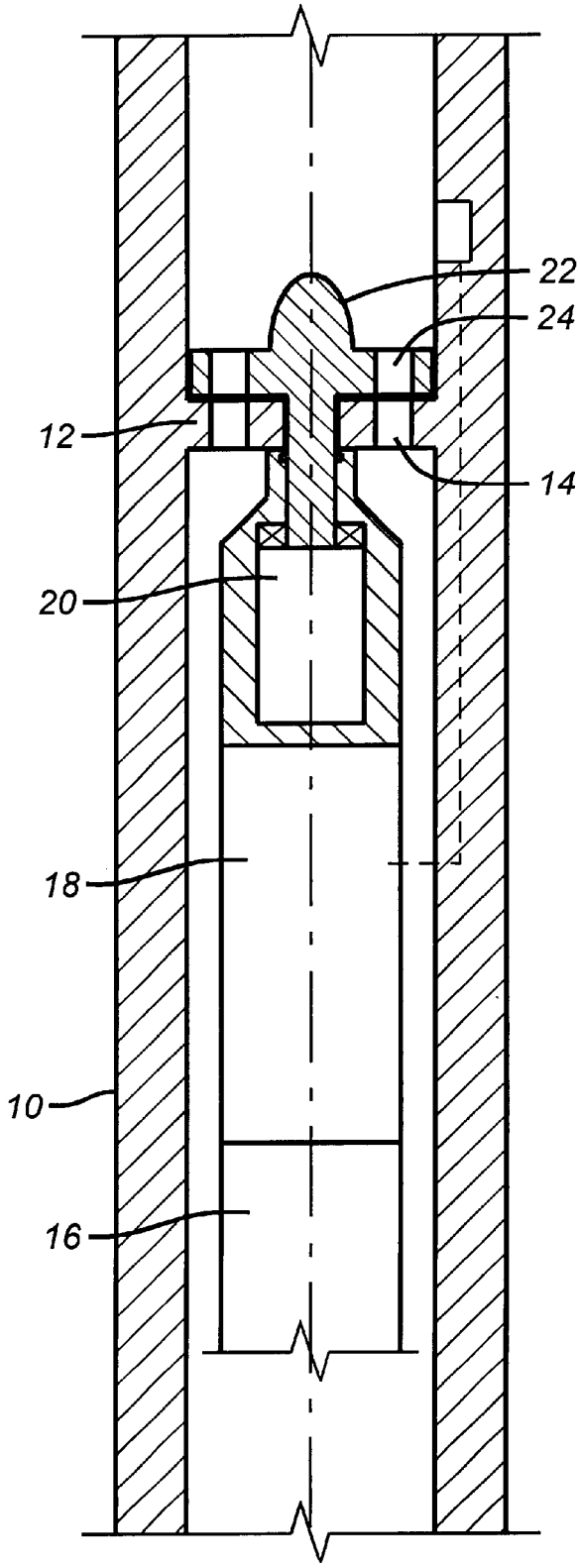
FIG. 1 is a sectional elevational view of the mud pulser valve.

FIG. 1 illustrates a drill collar 10 which is above the drill bit (not shown). Inside the drill collar 10 is a plate 12. Plate 12 has a series of openings 14. The shapes of the openings 14 in plate 12 are more clearly shown in FIG. 2 in plan view.

Figure 2:
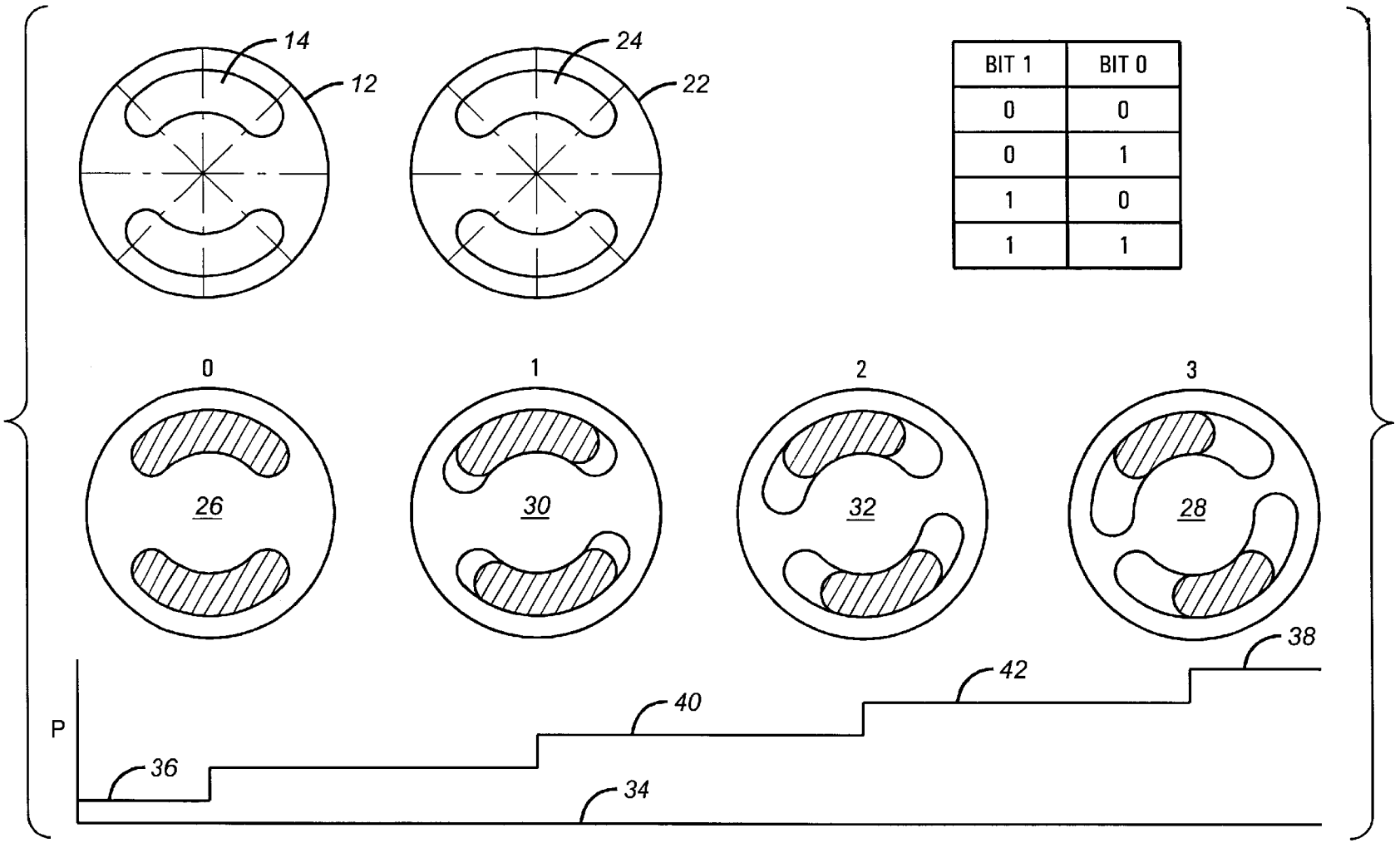
FIG. 2 shows four possible positions of the mud pulser and four amplitudes of the pulses generated in conjunction with those positions.

Supported within the drill collar 10 are downhole instruments 16 which are used for measurement of a variety of conditions downhole of the formation as well as the circulating mud. A processor 18 is mounted adjacent the instruments 16. One of the many functions of the processor 18 is to control the motor 20. Motor 20 is connected directly to plate 22, which is also shown in FIG. 2. Plate 22 has a series of openings 24 which, in the preferred embodiment, match the openings 14 of plate 12. The openings 14 and 24 are preferably crescent-shaped, but other configurations can be used without departing from the spirit of the invention. Motor 20 can orient plate 22 in different positions with respect to the fixed plate 12. FIG. 2 shows, from left to right, the maximum open position 26, the minimum open position 28, and two intermediate positions, 30 and 32. Also shown in FIG. 2 is a plot of pressure pulses generated, plotting the amplitude of the pulse against time. The baseline 34 represents the "no mud flow condition" in the wellbore and necessarily has an amplitude of "0" on the pressure scale which is on the "y" axis. Line 36 is the lowest amplitude pulse generated, which is consistent with the maximum open position 26. Similarly, line 38 is consistent with the minimum open position 28 and, therefore, has the highest amplitude. In between lines 40 and 42 represent the pulse generated with the plates in the positions indicated at 30 and 32. Those skilled in the art will appreciate that there is a great degree of variability in selecting each of the amplitudes of the pulses to be used in the telemetry system. Thus, the values of any of the lines 36–42 can be in equal increments or unequal increments, and the lowest to highest values can also vary. The processor 18, working in conjunction with the motor 20, can be used to achieve, within reason, any number of discrete pulse levels, the limiting value being that the pulse pressure amplitudes cannot be so close in height so as to make them indistinguishable at the surface in view of all the other conditions prevailing in the wellbore.

Figure 3:
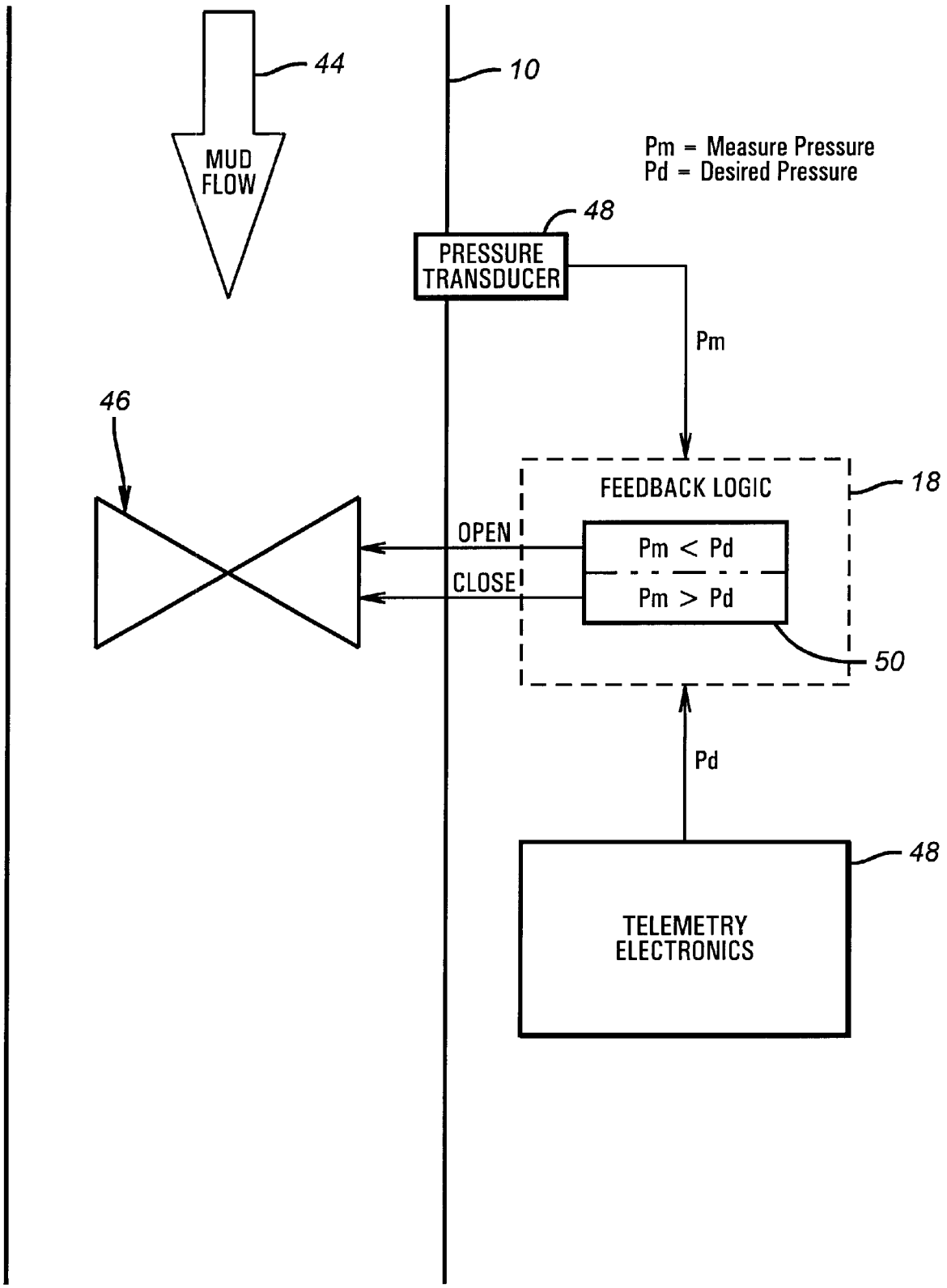
FIG. 3 is a schematic of the control system for the mud pulser.

The operation of the control system is illustrated in FIG. 3. Arrow 44 schematically represents the mud flow in the drill collar 10 past the mud pulser valve 46, which is illustrated in FIG. 1. A pressure transducer 48 is mounted in the drill collar 10. It measures the internal drill collar pressure, known as $p_m$, and provides that measured pressure signal to the processor 18. Telemetry electronics 48, generally located in the processor section 18, has stored within the desired pressure, $p_d$, of the pulse to be generated. Located within the processor 18 is a comparator 50 which compares the desired pressure $p_d$ to the measured pressure $p_m$ at the transducer 48 and determines which is greater. If $p_m$ is less than $p_d$, a signal is given through the motor 20 to close the pulser valve 46 by a discrete amount. Conversely, if $p_m$ exceeds $p_d$, a signal is given to the motor 20 to open the pulser valve 46 by a discrete amount. Each time the pressure transducer 48 takes a measurement, the process just described repeats itself. The telemetry electronics 48 can also process the transducer readings 48 to take first and higher order measurements so that not only is the absolute pressure value sensed, but trends in the change in pressure values over time can also be sensed to enhance the ability to control the position of the pulser valve 46 in order to produce the desired pulse amplitude, as illustrated, for example, in FIG. 2, while minimizing overshot and hunting.

Those skilled in the art can now see that the system described above, by increasing the number of available pressure pulse amplitudes dramatically increases the quantity of data encoded or the number of bits transmitted without increasing the frequency of the transmitted signal. The pressure measurement is direct at transducer 48. The output from the comparator 50 results in a direct physical movement of the motor 20, which in the preferred embodiment can be a stepper motor. There is no dependence on the circulating mud to position the pulser valve 46, as disclosed in U.S. Pat. No. 5,586,084. The control of the pulser valve 46 is direct by motor 20. Wear in the openings 14 and 24 can be compensated for by the processor 18. In essence, at the start of operations, the baseline is established for the various pulses, as shown in FIG. 2. Thereafter, the relative positions of the plates 12 and 22 can be adjusted to duplicate the target amplitudes shown in FIG. 2 for the discrete pulses initially established. Thus, because the control system illustrated in FIG. 3 for the positioning of the pulser valve 46 is not dependent on flow and/or pressure drop conditions for movement of the pulser valve 46, duplication of the pulse heights shown in FIG. 2 can occur, despite any erosive effects on the openings 14 and 24 from the grit in the circulating mud. Similarly, within a certain range, a change in the pressure and/or mud flowrate can also be compensated for by the processor 18. This is because the pulse heights are measured directly at transducer 48 such that upon change in the flow and pressure conditions of the mud, the positions 26–32 can be varied so as to replicate the initial standard pulse heights illustrated in FIG. 2 which are initially established. Should the variation in mud flowrate and pressure exceed a certain predetermined limit, the processor 18 can reestablish new pulse amplitudes for the then-existing conditions and so inform the surface processor that it is, in fact, reestablishing a new correlation between the pulse amplitudes and the existing mud circulation conditions.

Additionally, the shape of the pulse can also be controlled by this invention. It is known in the art that pulses can become skewed in time and thus made harder to detect at the surface because of shape or phase distortion. The pressure feedback and rapid aperture response of the present invention allows optimal pulse shaping for optimal detection at the surface.

In other respects, the nature of the pulse signaling generated by the pulser valve 46 using binary 0's and 1's is similar to the techniques of the prior art, such as, for example, illustrated in U.S. Pat. No. 5,586,084. The design of the actual pulser valve 46 itself is commonly referred to as a shear valve and can be of a type used and disclosed in U.S. Pat. No. 4,630,244.

With the present invention, narrow bypass passages which could clog up with grit and other particles in the drilling mud, are not employed. These techniques represent one of the shortcomings in the prior attempts to transmit larger amounts of data faster, as illustrated in U.S. Pat. No. 5,586,084. Yet another advantage of the present invention is the direct control of the mud pulser 46 and the ability to more finely control the shape of the pulses, such as illustrated in FIG. 2, by sensing on a frequent basis the pressure pulses generated in the drill collar 10, while having in place a system to compensate for wear on the mud pulser valve 46 as well as change in flow and pressure conditions of the drilling mud. The system is not limited to predetermined amplitude variations of the various pulses which are to be generated. It is highly variable and can be set up for the conditions of a particular well. This is to be contrasted with the technique in U.S. Pat. No. 5,586,084 which in one embodiment requires discrete relief valves for the purpose of generating the multiple amplitudes. Because of the nature of the driving system for the poppet in that prior technique, there also exists a possibility of not being able to finely control the movements of the poppet as it hunts below and above the desired final setpoint for each of the relief valves selected. While U.S. Pat. No. 5,586,084 illustrates an alternative embodiment replacing the discrete relief valves with a variable choke, the control in that system is still indirect as it throttles a flow in a bypass line rather than giving direct command controls to the poppet by physically moving it to a proper position. As a result, the technique of the present invention allows for a great deal of variability in selecting a multiplicity of amplitudes for pulses and a high degree of repeatability, despite changing conditions in the flowing mud or in the valve 46 itself.

The foregoing disclosure and description of the invention are illustrative and explanatory thereof, and various changes in the size, shape and materials, as well as in the details of the illustrated construction, may be made without departing from the spirit of the invention.

What is claimed is:

1. A control system for generating multilevel signals in a tubular string having a flowpath and a downhole telemetry system using a pulser valve in said flowpath, comprising:

a pulser valve operable in multiple positions comprising a maximum and minimum open position and at least one position in between;

a driver connected to said pulser valve; and a flowpath mounted controller connected to said driver so as to create pulses with said pulser valve by commanding said driver to re-position said pulser valve in fixed increments independent of flow and pressure conditions of circulating mud.

2. The system of claim 1, further comprising:

a pressure sensor mounted in a position downhole to sense the amplitudes of pressure pulses created by operation of said pulser valve and communicate said measured pressures to said controller.

3. The system of claim 2, wherein:

said controller is capable of creating baseline amplitudes of pressure using said sensor as feedback, each baseline amplitude corresponding to a different position of said pulser valve.

4. The system of claim 3, wherein:

said controller compensates for wear in said pulser valve by using feedback from said sensor to alter at least one position of said pulser valve to achieve any desired pulse amplitude previously established as baseline.

5. The system of claim 3, wherein:

said controller uses pressure measurements of said sensor to change pulse shape to optimize surface detection by commanding through said driver a variation in at least one preset position corresponding to a baseline desired amplitude.

6. The system of claim 3, wherein:

said pulser valve comprises a movable plate directly driven by said driver and having at least one opening thereon and a stationary plate having at least one opening thereon.

7. The system of claim 6, wherein:

said driver rotating said movable plate to alter the alignment between openings on said plates to create desired pressure amplitudes for signal transmission to the surface.

8. A control system for generating multilevel signals in a downhole telemetry system using a pulser valve, comprising:

a pulser valve operable in multiple positions comprising a maximum and minimum open position and at least one position in between;

a driver connected to said pulser valve; and a controller connected to said driver so as to create pulses with said pulser valve by commanding said driver to position said pulser valve;

a pressure sensor mounted in a position downhole to sense the amplitudes of pressure pulses created by operation of said pulser valve and communicate said measured pressures to said controller;

said controller is capable of creating baseline amplitudes of pressure using said sensor as feedback, each baseline amplitude corresponding to a different position of said pulser valve;

said controller using said sensor determines when well conditions have changed sufficiently so that baseline amplitudes can no longer be achieved with previously set pulser valve positions whereupon said controller establishes new positions of said pulser valve to reobtain said previously used baseline amplitudes.

9. The system of claim 8, wherein:

said controller signals to the surface to the effect that new positions of said pulser valve are being selected to correspond to new or to the preexisting baseline pressure amplitudes.

10. A telemetry method for sending signals from downhole to the surface, comprising:

providing a multiposition pulser valve downhole;

creating a plurality of pressure amplitudes with said pulser valve; and providing a driver to directly position said pulser valve in predetermined increments independent of flow and pressure conditions of circulating mud so as to obtain said amplitudes.

11. The method of claim 10, further comprising:

providing a pressure sensor for measuring amplitude of pressure pulses created by said pulser valve;

communicating measured pulses to a controller; and regulating said driver with said controller.

12. The method of claim 11, further comprising:

using said pressure sensor to compensate for wear in said pulser valve by having said controller direct a change in movement of said driver so as to reposition said pulser valve to obtain the desired pressure amplitude despite said wear.

13. The method of claim 11, further comprising:

programming said controller with a plurality of desired amplitudes; and using said pressure sensor for feedback to said controller to obtain said desired amplitudes.

14. The method of claim 11, further comprising:

using said controller to change the shape of the generated pressure pulse by controlling the operation of said driver and in turn said pulser valve so as to optimize surface detection of the signal.

15. The method of claim 11, further comprising:

using a stationary and a rotating disc with an opening on each as said pulser valve;

driving said rotating disc directly with said driver on command from said controller; and changing the opening size through said discs by said rotation of said rotating disc.

16. A telemetry method for sending signals from downhole to the surface, comprising:

providing a multiposition pulser valve downhole;

creating a plurality of pressure amplitudes with said pulser valve; and providing a driver to directly position said pulser valve so as to obtain said amplitudes;

providing a pressure sensor for measuring amplitude of pressure pulses created by said pulser valve;

communicating measured pulses to a controller; and regulating said driver with said controller;

establishing a plurality of discrete amplitudes as a baseline;

using said sensor in conjunction with said controller and said driver to obtain said amplitudes; and communicating said baseline amplitudes to the surface.

17. A telemetry method for sending signals from downhole to the surface, comprising:

providing a multiposition pulser valve downhole;

creating a plurality of pressure amplitudes with said pulser valve; and providing a driver to directly position said pulser valve so as to obtain said amplitudes;

providing a pressure sensor for measuring amplitude of pressure pulses created by said pulser valve;

communicating measured pulses to a controller; and regulating said driver with said controller;

programming said controller with a plurality of desired amplitudes; and using said pressure sensor for feedback to said controller to obtain said desired amplitudes;

comparing the measured amplitude to the desired amplitude; and using said controller to actuate said driver to reposition said pulser valve to allow an approach to the desired amplitude.

18. A telemetry method for sending signals from downhole to the surface, comprising:

providing a multiposition pulser valve downhole;

creating a plurality of pressure amplitudes with said pulser valve; and providing a driver to directly position said pulser valve so as to obtain said amplitudes;

providing a pressure sensor for measuring amplitude of pressure pulses created by said pulser valve;

communicating measured pulses to a controller; and regulating said driver with said controller;

programming said controller with a plurality of desired amplitudes; and using said pressure sensor for feedback to said controller to obtain said desired amplitudes;

processing the measured pressure and its rate of change by said controller;

using said measured pressure and rate of change information to command said driver to alter the position of said pulser valve in a manner so as to minimize hunting or overshot of the targeted amplitude.

19. A telemetry method for sending signals from downhole to the surface, comprising:

providing a multiposition pulser valve downhole;

creating a plurality of pressure amplitudes with said pulser valve; and providing a driver to directly position said pulser valve so as to obtain said amplitudes;

providing a pressure sensor for measuring amplitude of pressure pulses created by said pulser valve;

communicating measured pulses to a controller; and regulating said driver with said controller;

sensing when well flow conditions have changed to no longer permit the desired amplitudes to be achieved with available positions of said pulser valve;

creating new baseline amplitudes with said controller for the new well flow conditions;

communicating to the surface a signal that new baseline amplitudes have been selected; and using the newly created baseline amplitudes for signal transmission to the surface.

* * * * *